United States Patent [19]

Szabo et al.

[11] 4,400,919

[45] Aug. 30, 1983

[54] MOBILE HOME SKIRTING SYSTEM

[75] Inventors: Robert J. Szabo; Garfield W. Stovin, both of Kansas City, Mo.

[73] Assignee: Variform Plastics, Inc., Kearney, Mo.

[21] Appl. No.: 255,302

[22] Filed: Apr. 17, 1981

[51] Int. Cl.[3] ..... E04C 1/30; E04B 2/82; B60R 27/00

[52] U.S. Cl. ..... 52/169.12; 52/530; 52/586; 52/588; 280/768

[58] Field of Search ..... 280/768; 52/155, 169.12, 52/529, 530, 531, 532, 533, DIG. 3, 585, 586, 588, 478

[56] References Cited

U.S. PATENT DOCUMENTS

| | | | |
|---|---|---|---|
| 2,988,380 | 6/1961 | Puckett et al. | 280/768 |
| 3,113,357 | 12/1963 | Reukauf et al. | 280/768 |
| 3,119,473 | 1/1964 | Mitchell | 52/529 |
| 3,710,525 | 1/1973 | Lopes | 52/169.12 |
| 3,832,813 | 9/1974 | Hindman | 52/169.12 |
| 4,043,088 | 8/1977 | Payton | 52/169.12 |
| 4,107,888 | 8/1978 | Krueger | 52/169.12 |
| 4,214,412 | 7/1980 | Barylski | 52/169.12 |

FOREIGN PATENT DOCUMENTS

| | | | |
|---|---|---|---|
| 1022719 | 12/1977 | Canada | 52/169.12 |

*Primary Examiner*—Alfred C. Perham
*Assistant Examiner*—Eugene R. Washington
*Attorney, Agent, or Firm*—Schmidt, Johnson, Hovey & Williams

[57] ABSTRACT

A continuous skirt for surrounding an elevated building to close the space therebeneath is provided with a series of releasably interconnected panels wherein the interlocks therebetween are, in turn, provided with elongated, upstanding stays capable of rendering the interconnections rigid. The stays operate to present guides or tracks for restraining the panels to vertical reciprocation as the result of changes in the contour of the ground arising from expansion and contraction and also to resist lateral movement of the panels under blowing wind conditions. In each of the embodiments, structure is provided for precluding the panels from gouging into the side of the building and thereby failing to rise properly as needed, all of the improvements being directed toward avoidance of cracking, breakage or other damage to the skirt.

11 Claims, 8 Drawing Figures

Fig. 1.
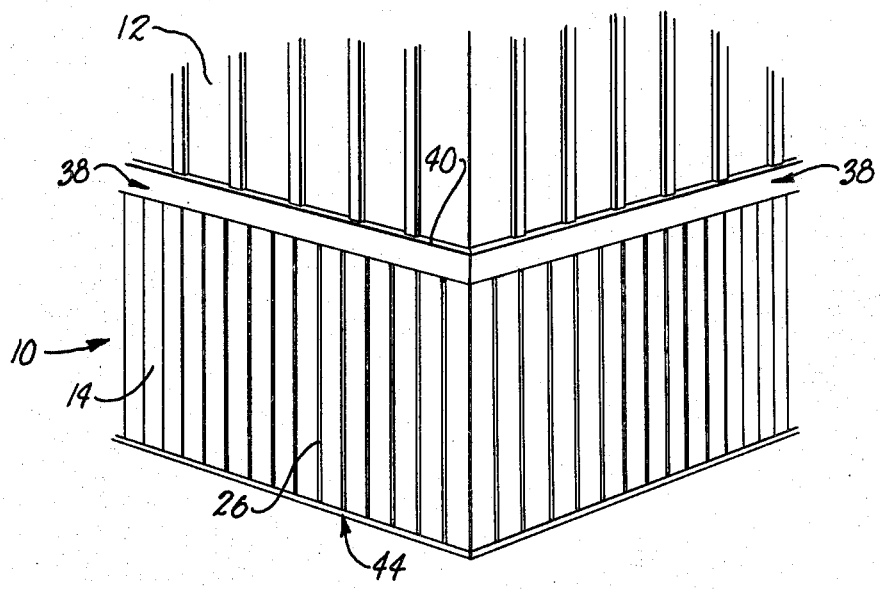
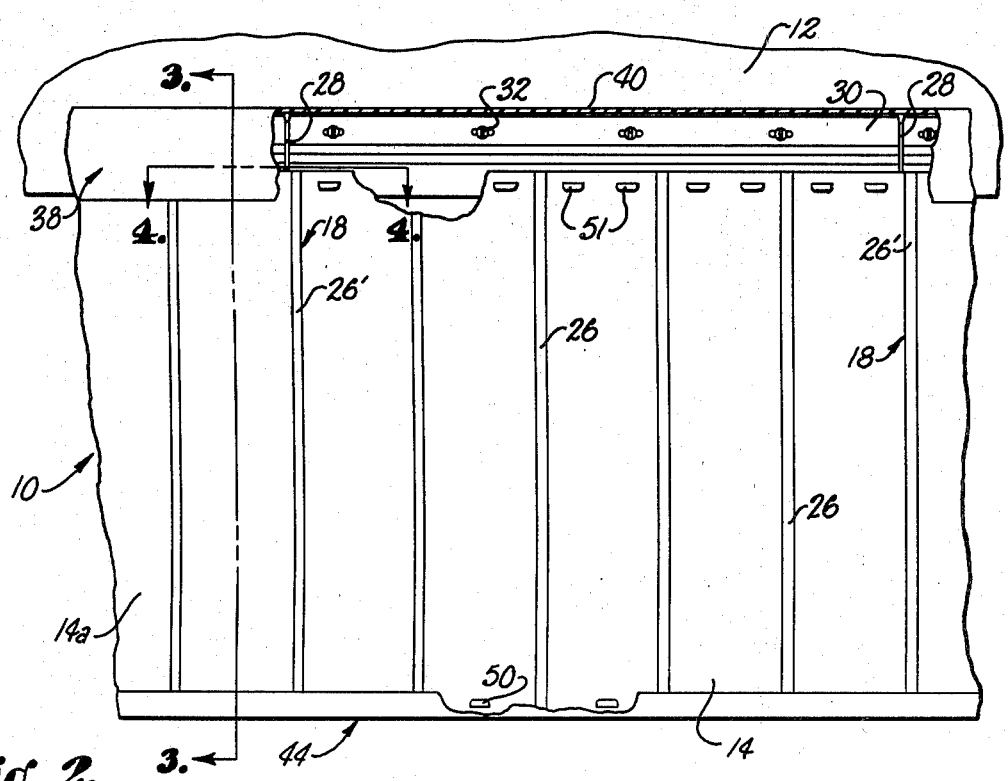
Fig. 2.

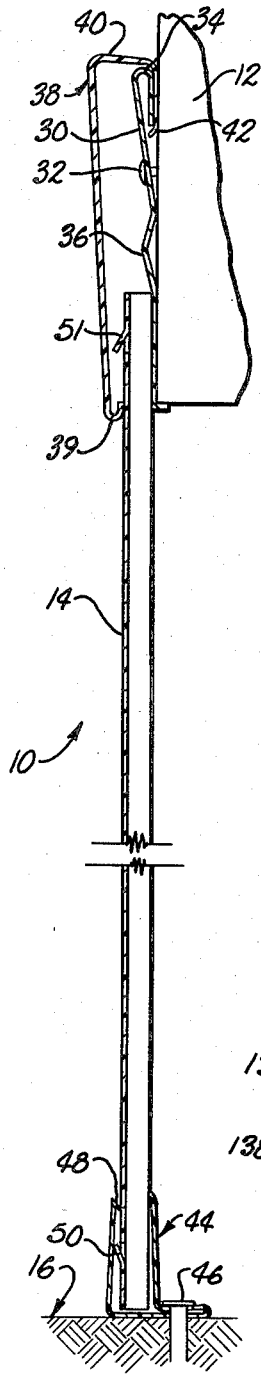
Fig. 3.
Fig. 4.
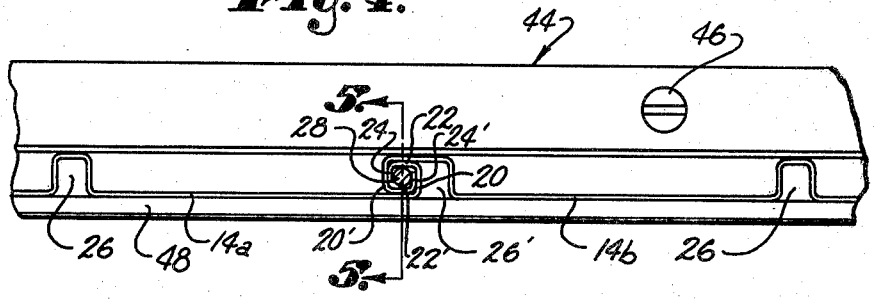
Fig. 5.
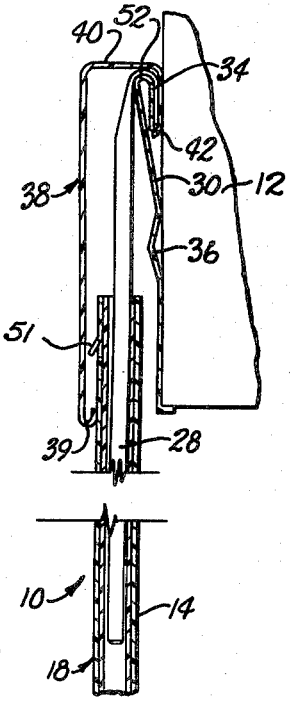
Fig. 6.
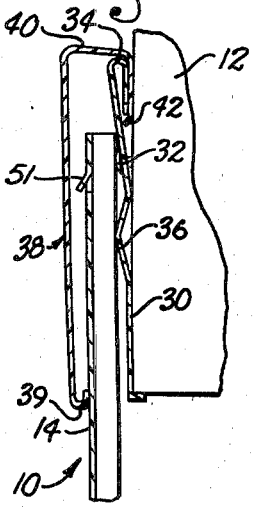
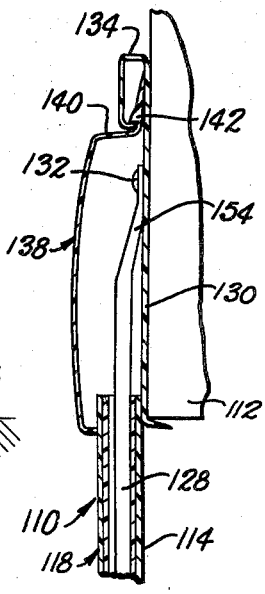
Fig. 7.
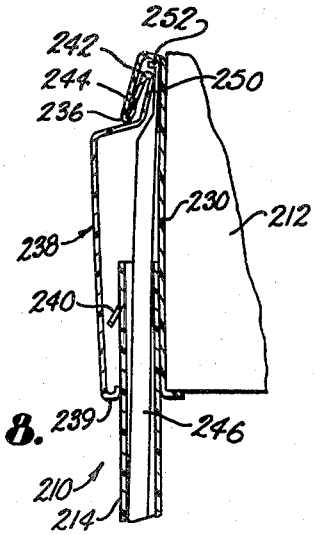
Fig. 8.

MOBILE HOME SKIRTING SYSTEM

Elevated buildings, such as mobile homes are somewhat universally provided with circumscribing skirts for closing the space beneath the building, the advantages emanating from the use of the skirting being well-known. In the interest of simplicity, savings in expense and ease of installation, it is commonplace to construct the skirting by use of a continuous series of relatively lightweight, yet strong plastic panels releasably interconnected at their continuous edges by various types of interlocks. Railings are provided around the building for mounting and decorative purposes and, still another railing is normally provided at the bottom of the skirt resting on the ground. The skirting is held in place by arrangements which permit the skirt or the individual panels to freely rise and fall in response to changes in ground contour arising, for example, from settling or from freezing and thawing conditions.

However, difficulties have arisen because of the fact that the skirt does not necessarily rise and fall along a vertical path and because of the fact that there is no uniformity in the changes of the ground contour, resulting in inequalities in the extent of such movement by each of the several panels forming the skirt.

In accordance with our present invention there is provided a plurality of stays in the nature of elongated, upright rods so associated with the skirting as to restrain the movement of the panels to a substantially vertical path. Each of the stays is associated advantageously with the aforementioned interlock structure such as to form a part thereof. The stays themselves are provided with means of attachment at their upper ends to the building such that the panels move up and down with respect to the stays themselves. Moreover, provision is made for obviating the possible disadvantage of the panels coming into contact at their upper edges with the building, thereby impeding freedom of the desired flotation.

In the drawings:

FIG. 1 is a fragmentary, perspective view of a mobile home surrounded by a continuous skirt;

FIG. 2 is an enlarged, fragmentary side elevational view of the skirt, parts being broken away from clearness;

FIG. 3 is an enlarged, cross-sectional view taken on line 3—3 of FIG. 2;

FIG. 4 is an enlarged, fragmentary, cross-sectional view taken on line 4—4 in FIG. 2;

FIG. 5 is a fragmentary, cross-sectional view taken on line 5—5 of FIG. 4;

FIG. 6 is a cross-sectional view similar to FIGS. 3 and 5 showing the panel moved upwardly;

FIG. 7 is a cross-sectional view similar to FIG. 5 of an alternative embodiment of the present invention; and FIG. 8 is a cross-sectional view similar to FIG. 5 and showing a yet further alternative embodiment of the invention.

In the embodiment of our invention depicted by FIGS. 1–6 there is provided a closure 10 for use as shown in FIG. 1 in connection with an elevated building 12, such as a mobile home, the closure 10 being in the nature of a skirting which surrounds the building 12 and thereby closes the space beneath the building 12.

The closure skirt 10 is made up of a plurality of initially separate elongated panels 14 disposed in edge-to-edge relationship and spanning the distance between the upper surface 16 of the ground (FIG. 3) and the building 12, preferably in overlapping relationship to the latter as is apparent in FIGS. 2–6.

Each of the upright ground-supported panels 14 is provided with means to present upright interlock structures broadly designated by the numeral 18, as best seen in FIG. 4 of the drawings. Hence, a panel 14*a* has a lateral (inward) extension 20 extending throughout one of its upright edges, the extension 20 continuing into a reverse bend 22 with the latter terminating in a return flange 24.

On the other hand, the next adjacent panel 14*b* has a number of reinforcing corrugations 26, one of which, designated 26' is provided with a lateral extension 20', a reverse bend 22' and a return flange 24'.

In accordance with our present invention, the interlock 18 includes additionally an upright stay in the nature of a rod 28 centrally disposed such as to slidably engage the flanges 24 and 24' therebetween. As shown also in FIG. 4, the reverse bends 22 and 22' are also so disposed as to slide vertically along the rod 28.

In FIGS. 2, 3, 5 and 6 there is illustrated a mounting plate broadly designated by the numeral 30 which surrounds the building 12 and is attached thereto by a series of fasteners 32. The plate 30 is provided with a loop 34 extending along its upper, normally horizontal extremeity, and a protuberance 36 in the plate 30 projects outwardly from the building 12 intermediately upper and lower edges of the plate 30.

A retainer 38 for the skirt 10 bears somewhat yieldably against the upper marginal portions of panels 14 at the lower edge of the retainer 38 as by inturned, return stretch 39. At its upper extremity, the building surrounding retainer 38 is provided with a hook 40 which terminates adjacent the building 12 in a snap lock 42, which engages behind loop 34.

A bottom rail 44 (FIGS. 1–4), resting on the ground surface 16 and anchored thereto by a plurality of stakes 46, is channeled upwardly to receive all of the panels 14, the rail 44 having a number of catches 48 adapted for engaging corresponding tabs 50 on the panels 14. An outwardly extending lip 51 is also provided adjacent the upper marginal portion of each of the panels 14, for engagement with the hooks presented by return stretch 39.

The rod 28 terminates well above the rail 44 as shown in FIG. 5, but each rod 28 extends well above the skirt 10 (FIG. 5) terminating in a hanger 52 at its uppermost end.

In the modification depicted by FIG. 7 of the drawings, skirt 110 for building 112 is provided with a series of panels 114 not necessarily unlike the panels 14, interconnected by interlock structures 118 of the same nature as the structures 18. Also, here again, one or more of the structures 118 is provided with an upright stay rod 128, all of which terminate well above the ground and all extending upwardly beyond the normally upper edges of the panels 114.

A mounting plate 130 is somewhat similar to the plate 30 except that there is no requirement for the protuberance 36. A continuous loop 134 is formed along the upper portion of the plate 130, the loop 134 extending outwardly and downwardly with respect to the building 112 as distinguished form the shape and configuration of the loop 34.

A retainer 138 in FIG. 7 is provided with a hook 140, the latter having a continuous, downwardly opening snap lock 142 located within the loop 134.

The stay rods 128 incorporated within the otherwise well-known and publicly used embodiment of FIG. 7, differ from the stay rods 28 in that they are provided with an offset 154 at their upper ends operating to dispose the remainder of the rods 128 in spaced relationship to the plate 130 in a manner somewhat different from the way in which the hanger 52 orients the rods 28 as shown for example in FIG. 5. In this instance, the rods 128 are attached to the plate 130 by fasteners 132, the latter of which may well serve the additional function of attaching the plate 130 to the building 112.

In the embodiment of FIG. 8, skirt 210 for building 212 is formed of a series of panels 214 interconnected by interlock structure 218 similar to that of FIGS. 1–7. A mounting plate 230 is suitably attached to the building 212, mounting plate 230 presenting a loop 234 having an inwardly facing hook 236 formed at the normally lowermost edge thereof.

A retainer 238 overlies the upper marginal portions of panels 214 and plate 230 as shown. Retainer 238 has an inturned normally lowermost edge which presents a ledge 239 for engagement with a lip or tabs 240 formed along the upper marginal portion of the panels 214 whereby when pressure on the panels 214 builds up, such as by wind forces thereon, the ledge 239 and lip or tabs 240 will tightly engage one another to give the panels 214 a positive anchor.

The upper marginal portion of retainer 238 presents an outwardly facing hook 242 which has its free edge 244 seated within inwardly facing hook 236 when the retainer is in place, this seating engagement serving to secure retainer 238 with respect to plate 230.

Stay rods 246 are provided for the embodiment shown in FIG. 8, each of said rods having a normally uppermost end portion 250 which is flattened and is provided at its free end with a laterally extending catch 252 which snaps under the upper edge of hook 242 to retain the rod in position with respect to the assembly, thereby making it unnecessary to otherwise secure rod 246 to the assembly or to building 212.

OPERATION

Installation of the skirting assembly 10 in association with the building 12 contemplates, at the outset, the attachment of the plate 30 to the outside of the building 12 adjacent its lower extremities through use of the fasteners 32.

Thereupon, the series of panels 14 may be joined together into a continuous building surrounding unit through use of the interlock structures 18 which, as aforementioned, includes the rods 28, assuming, of course, that one desires to provide such a rod 28 for each interlock 18 respectively. Manifestly, the assembled skirt 10 is placed in surrounding relationship to, and in engagement with the previously attached plate 30. Additionally, of course, the panels 14 are associated with the bottom rail 44 and the latter held in place through use of the stakes 46 such that the panels 14 are all essentially vertical.

The installation is completed by the attachment of the retainer 38 and, in this connection, it can be seen that the workmen need only slip the hook 40 into place over the loop 34, between the building 12 and the loop 34 until the lock 42 snaps automatically into place beneath the lower free edge of the loop 34 as is apparent in FIGS. 3, 5 and 6.

It can now be seen that as the contour of the ground surface 16 changes, rising, falling and buckling, thereby raising and lowering the bottom rail 44, the skirt 10 and particularly all of its panels 14 move up and down within the retainer 38 between the latter and the plate 30. The protuberance 36, being within the path of upward movement of the panels 14, serves to deflect the latter outwardly away from the building 12, thereby assuring freedom of panel movement, whether or not the panels 14 tend to bow or warp, all because of the fact that the upper edges of the panels 14 slide easily and readily along the plate 30 without engaging or gouging the building 12 itself. That is to say, as shown in FIG. 5, the stay rods 28 tend to hold the panels 14 spaced from the plate 30, and, therefore, the building 12 such that, in cooperation with the rail 44, the panels 14 are held in a vertical position and normally rise and fall along a vertical path of travel. However, in zones between the stays 28, the panels may well bow inwardly to a position where they actually engage the plate 30 beneath the protuberance 36 as shown in FIG. 3. Hence, as FIG. 6 of the drawings well illustrates, the protuberance 36 will properly deflect and guide the panels as they tend to rise to a position well above the protuberance 36.

In virtually all respects the operation of the assembly illustrated in FIG. 7 is the same as the operation of the embodiment shown in FIGS. 1–6. The panels 114 will slide readily and easily along the rods 128 as well as along the plate 130, essentially unimpeded toward and away from the offset 154.

In assembly, after mounting the plate 130 and the stays 128 on the building 112, it is but necessary to shift the retainer 138 into place by insertion of the upstanding portion of the hook 140 between the plate 130 and the lowermost terminal edge of the loop 134 until the lock 142 snaps into place hooked along the lower, inner edge of the loop 134, at which time, the retainer 138 becomes yieldably biased against the outer face of the skirt 110.

The embodiment of FIG. 8 operates similarly; that is, the mounting plate 230 is secured to the building 212; the retainer 238 is engaged with plate 230 and the panels and rods are inserted beneath the lower edge 239 of retainer 238 whereby the tabs or lips 240 are moved above edge 239 and catch 252 is snapped behind and above hook 242 as described. The lowermost edges of panels 214 would be secured in the same manner as illustrated in FIG. 3.

In all embodiments disclosed, it will be apparent that the stay rods 28, 128 and 246 serve to stabilize the skirt against lateral movement induced, for instance, by wind pressures. Thus, when the panels 14, 114 and 214 are of such a length to compensate for ground heave, or become spaced above the ground due to heaving or other vertical displacement thereof, the stay rods will prevent "blow out" of the panels due to wind pressures thereon. Accordingly, the stay rods 28, 128 and 246 not only serve to restrain the panels to vertical reciprocation, but also to prevent excessive lateral; that is, in and out with respect to the plane of the building 12, 112 or 212, swinging movement thereof, all to the end that the panels 14, 114 and 214 and, therefore, the closure skirting 10, 110 and 210 are retained in the desired position in vertical alignment with respect to the side of the building 12, 112 or 212 with which it is associated.

We claim:

1. In an elevated building having a space therebeneath, a skirt for said space comprising:

a plurality of upright ground-supported panels disposed in edge to edge relationship;

interlock structure on the adjacent edges of the panels, said structure including mating extensions for releasably interconnecting said adjacent panel edges, said extensions cooperating to present an upright passage therebetween; and upright stays received within certain of said passages for guiding the skirt for up and down movement thereof relative to the building during changes in the contour of said ground and resisting lateral movement of the skirt, said skirt being adjacent the building when placed in surrounding relationship thereto, each stay extending above the skirt and having means at the upper end thereof for coupling the same with the building.

2. The invention of claim 1; and means adapted for connection with the building within the path of upward movement of the skirt for deflecting the latter away from the building.

3. The invention of claim 1, a mounting plate adapted for connection to the building in surrounding relationship thereto; a skirt retainer surrounding the skirt in engagement therewith; and hook means on the retainer, looped over said plate, surrounding the building and resting on the latter for attaching the retainer to the plate.

4. The invention of claim 3, each stay extending above the skirt and having means at the upper end thereof for engaging the plate.

5. The invention of claim 4, said upper end of the stays being disposed between the plate and the retainer.

6. The invention of claim 5, said plate having means within the path of upward movement of the skirt for deflecting the latter away from the building.

7. The invention of claim 1, each stay having an offset adjacent the upper end thereof for holding the skirt spaced from the building to provide freedom for said up and down movement thereof.

8. The invention of claim 7; a mounting plate adapted for connection to the building in surrounding relationship thereto; a skirt retainer surrounding the skirt in engagement therewith; and means on the retainer for attaching the latter to the plate, said skirt being in sliding engagement with the retainer and the plate during up and down movement of the skirt.

9. The invention of claim 8, said means for coupling the stays to the building being adapted for connecting the plate to the building.

10. The invention of claim 1, a mounting plate adapted for connection to the building in surrounding relationship thereto and presenting an inwardly facing hook; a skirt retainer surrounding the skirt in engagement therewith; and hook means on the retainer, the free edge of said hook engaging the inwardly facing hook of said plate for attaching the retainer to the plate.

11. The invention of claim 10, said stays each having a catch at its upper end, said catch being adapted to engage the hook in said retainer whereby to support the stays with respect to said panels.

* * * * *